US006866396B2

(12) United States Patent
Ward

(10) Patent No.: US 6,866,396 B2
(45) Date of Patent: Mar. 15, 2005

(54) ILLUMINATING DEVICE WITH ROTATABLY ADJUSTABLE SUPPORT

(75) Inventor: Lee Ward, Gaffney, SC (US)

(73) Assignee: JJI Lighting Group, Inc., Greenwich, CT (US)

( * ) Notice: Subject to any disclaimer, the term of this patent is extended or adjusted under 35 U.S.C. 154(b) by 0 days.

(21) Appl. No.: 10/266,603

(22) Filed: Oct. 9, 2002

(65) Prior Publication Data

US 2004/0070969 A1 Apr. 15, 2004

(51) Int. Cl.[7] ..... F21V 19/02

(52) U.S. Cl. ..... 362/220; 362/269; 362/287; 362/427; 362/430

(58) Field of Search ..... 285/272, 275, 285/278, 280, 282, 81, 89, 179, 180, 184; 74/567, 568 R; 403/43, 52, 53, 65; 211/123, 85.3; 362/223, 257, 260, 269, 285, 287, 382, 418, 427, 430, 103, 125, 127, 132, 145, 147, 217, 220, 225, 253, 368, 370, 372, 410, 413, 414, 404, 408, 406; 248/200, 274.1, 276.1, 278

(56) References Cited

U.S. PATENT DOCUMENTS

| | | | | | |
|---|---|---|---|---|---|
| 3,829,675 | A | | 8/1974 | Mariani | 240/1 |
| 4,121,280 | A | * | 10/1978 | Chapman et al. | 362/418 |
| 4,376,966 | A | | 3/1983 | Tieszen | 362/249 |
| 4,379,324 | A | | 4/1983 | Thompson | 362/253 |
| 4,494,177 | A | * | 1/1985 | Matthews | 362/402 |
| 4,533,983 | A | | 8/1985 | Hafstad | 362/223 |
| 4,698,734 | A | | 10/1987 | Ngai | 362/225 |
| 4,803,606 | A | * | 2/1989 | Rotter | 362/250 |
| 4,858,087 | A | * | 8/1989 | Hartshorn | 362/219 |
| 4,994,943 | A | * | 2/1991 | Aspenwall | 362/219 |
| 5,379,205 | A | * | 1/1995 | Peng | 362/430 |
| 5,474,187 | A | | 12/1995 | Taylor | 211/1.56 |
| 5,504,665 | A | * | 4/1996 | Osteen et al. | 362/287 |
| 5,690,237 | A | | 11/1997 | Marzec | 211/105.1 |
| 5,803,588 | A | | 9/1998 | Costa | 362/223 |
| 5,836,675 | A | | 11/1998 | Woodring | 362/234 |
| 6,161,948 | A | * | 12/2000 | Hagen | 362/418 |
| 6,241,365 | B1 | | 6/2001 | Cook | 362/253 |
| 6,280,056 | B1 | * | 8/2001 | Dolan et al. | 362/250 |
| 6,364,273 | B1 | * | 4/2002 | Otema | 248/444.1 |
| 6,439,748 | B1 | * | 8/2002 | Hsieh | 362/360 |
| 6,582,096 | B1 | * | 6/2003 | Searer | 362/253 |
| 6,588,915 | B1 | * | 7/2003 | Chen | 362/132 |
| 6,632,001 | B2 | | 10/2003 | Chen | 362/222 |

* cited by examiner

*Primary Examiner*—John Anthony Ward
*Assistant Examiner*—Ismael Negron
(74) *Attorney, Agent, or Firm*—Fitzpatrick, Cella, Harper & Scinto

(57) ABSTRACT

An illuminated garment holder includes at least one support member having a free end which is adapted to be secured to a wall or ceiling. The opposite end includes a connecting joint on which an elongated light fixture is rotatably mounted in a generally horizontal position. The light fixture includes a fluorescent bulb or the like, and a translucent lens through which light from the bulb is transmitted to the exterior of the fixture. The fixture can be rotated to any of the number of positions and locked in place to direct the light as desired. The fixture is dimensioned to support clothing hangers for garment displays.

24 Claims, 7 Drawing Sheets

ILLUMINATING DEVICE WITH ROTATABLY ADJUSTABLE SUPPORT

BACKGROUND OF THE INVENTION

1. Field of the Invention

The present invention relates to lighting fixtures, and more in particular, to a lighting fixture which is adapted to be used as a garment hanger and display.

2. Background of the Invention

Department stores and clothing stores commonly utilize stand alone or wall supported display systems or racks upon which clothing being offered for sale is displayed on conventional garment hangers or the like. In order to make the displays as attractive as possible, complex accent lighting schemes are designed to focus on the garments in a display. Such arrangements are not only complex and relatively expensive, but need to be revised each time a particular display or display rack is moved. Most typically, the displays or display racks themselves are simply pole-like structures which are supported on a floor stand, or from wall or ceiling support structures. Such display stands are offered for sale, for example, by ALU Spa of Italy, and are shown at that company's website www.alu.com.

SUMMARY OF THE INVENTION

It is an object of the present invention to provide a clothing display rack having an integrated illumination system.

Yet another object of the present invention is to provide an illuminated clothing display rack, which is relatively inexpensive in construction, and economical to manufacture.

A further object of the present invention is to provide an illuminated display rack for clothing in which the effects of the illumination can be varied.

A further object of the present invention is to provide an illuminated display rack which can be easily adjusted.

In accordance with one aspect of the present invention, an illuminated garment display rack is provided that includes a central generally cylindrical elongated light fixture whose diameter is selected to be such that a garment hanger can be conveniently placed on it. The light fixture has an internal source of light, such as a fluorescent bulb, and a translucent lens mounted thereon through which light from the source is projected. The lens extends across an arc of the cylindrical fixture of less than 180°.

The light fixture is rotatably mounted on one or more support arms which can be secured to a wall or ceiling. The rotatable mounting allows the direction in which the light is projected through the lens to be varied, i.e. directed either upwardly towards the ceiling, rearwardly towards the wall, or downwardly towards the garments hanging on the fixture, or anywhere in between. The position of the light fixture can be adjusted without disassembling the fixture, except for temporary removal of the lens.

The above, and other objects, features and advantages of this invention will be apparent in the following detailed description of an illustrative embodiment thereof, which is to be read in connection with the accompanying drawings wherein:

DETAILED DESCRIPTION OF THE PREFERRED EMBODIMENTS

Figure 1:
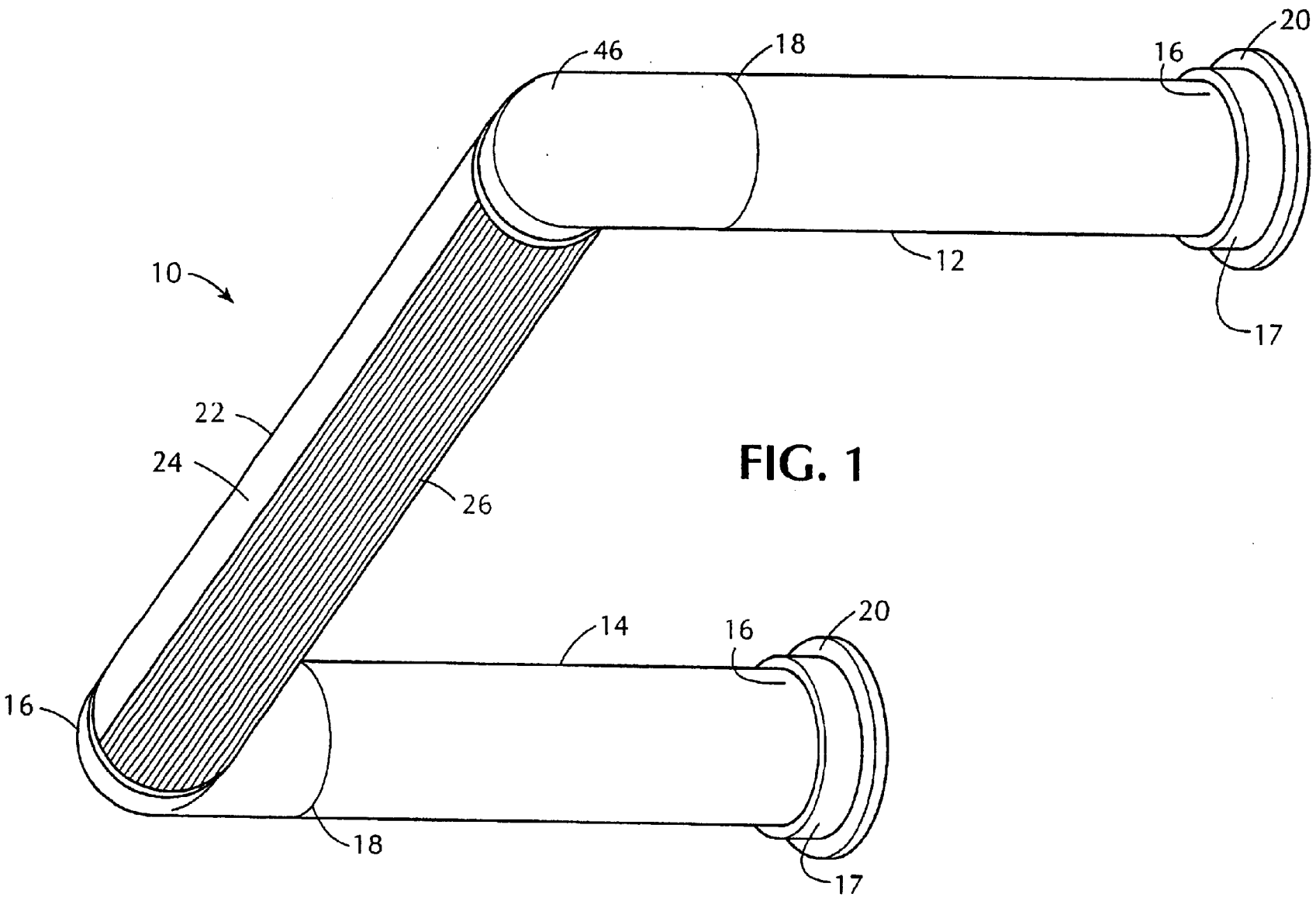
FIG. 1 is a perspective view from below of an illuminated garment holder constructed in accordance with the present invention.

Referring now to the drawings in detail, and initially to FIG. 1 thereof, an illuminated garment holder 10 is illustrated. The garment holder of this embodiment of the invention includes a pair of generally cylindrical hollow support members 12, 14, which have opposed ends 16, 18, respectively. These support members are adapted to be secured at their ends 16 in conventional support structure 20, which will support the elements 12, 14 horizontally from a wall or vertically from a ceiling. These structures may consist of collars 17 into which the ends 16 of the elements 12 and 14 are inserted to be held in place by set screws or the like. The support structures 20 in turn are mounted on the wall or ceiling in any convenient manner.

Figure 6:
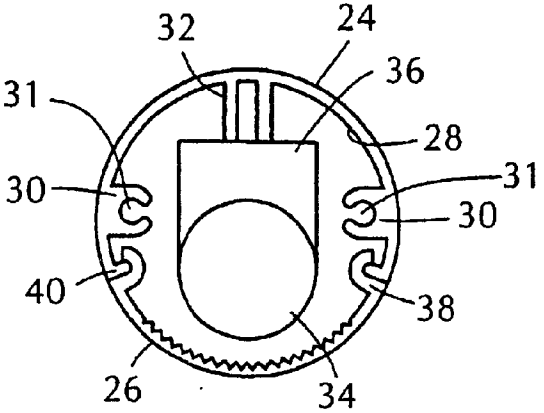
FIG. 6 is a sectional view taken along line 6—6 of FIG. 5.

The illuminated garment holder 10 includes an integrated light fixture 22 supported between the ends 18 of the support elements 12, 14. The light fixture 22 is generally cylindrical in shape, as illustrated for example in FIG. 6, and includes an extruded aluminum generally hollow housing 24 and a transparent lens 26. As seen in FIG. 6, housing 24 includes an internal surface 28 having cylindrical channel structures 30 formed therein, and a pair of support bars 32. A fluorescent light bulb 34 is supported in a conventional manner at its ends on conventional end connectors 36 which in turn are mounted on the bars 32 in any convenient and known manner.

Figure 5:
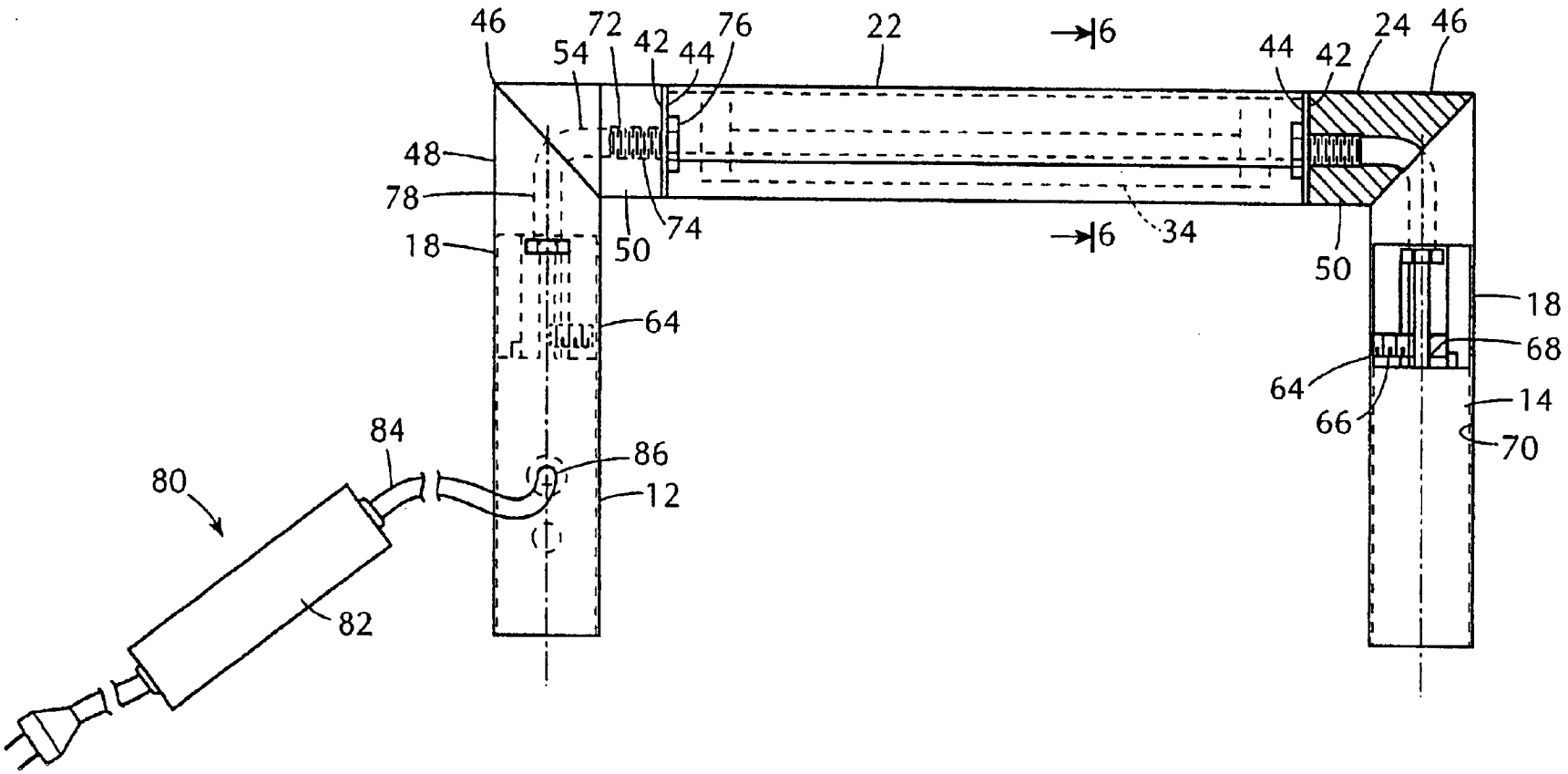
FIG. 5 is a plan view, with parts broken away, of the embodiment of the invention shown in FIG. 1.

As seen in FIG. 5, light fixture 22 has opposed end portions 42, which are closed by circular end plates 44. These end plates are secured to housing 24 by a pair of screws (not seen in the drawing) which are threaded through holes in the plates into the channels 31 of the channel structure 30 formed in the housing. As a result, the ends of the fixture 22 are relatively flat in the direction perpendicular to the longitudinal axis thereof.

Figure 3A:
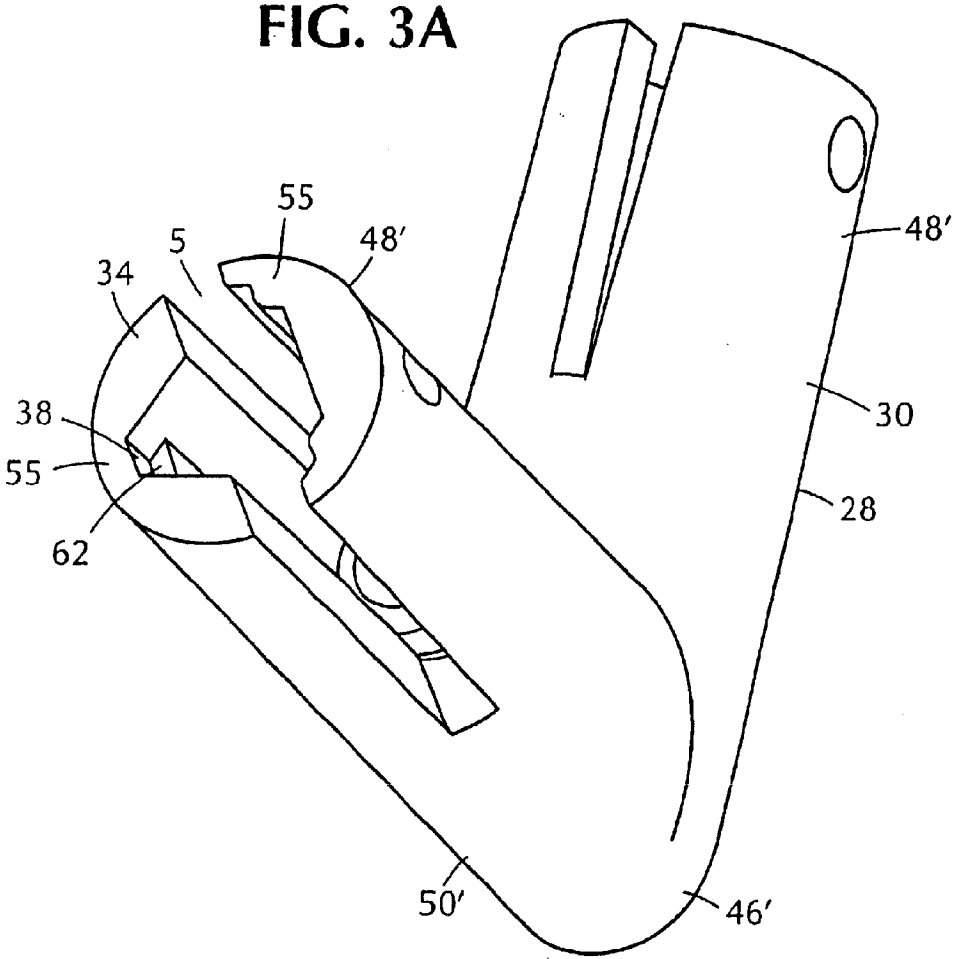
FIG. 3A is a view similar to FIG. 3, but of an elbow joint used in the embodiment of FIG. 2A.
Figure 3:
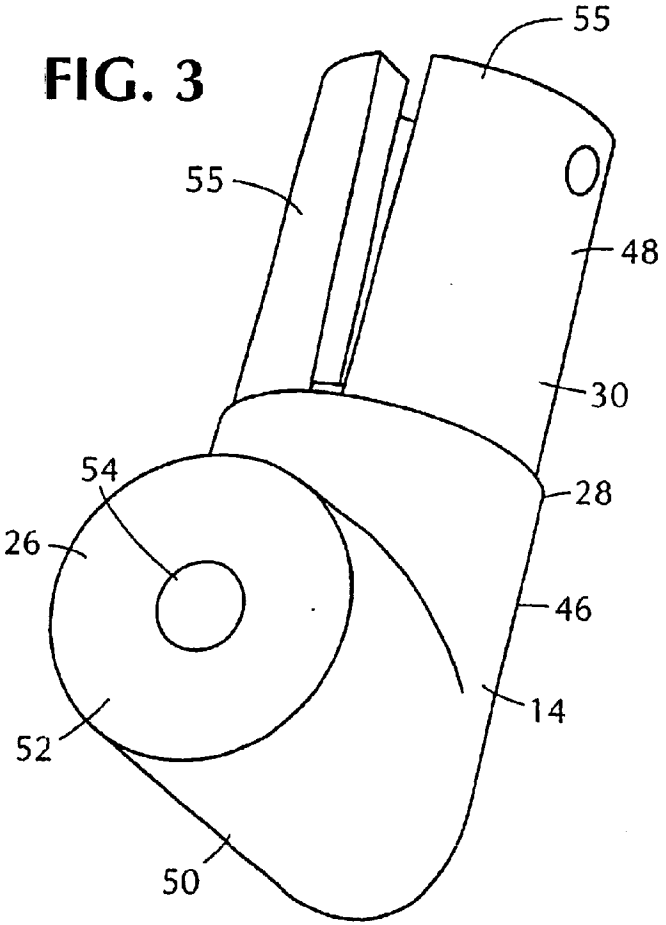
FIG. 3 is a perspective view of an elbow joint used in the device of the invention.

Light fixture 22 is connected to support members 14, 12 by connector elements 46, which are also referred to herein as connectors or elbows. These connector elements are illustrated in greater detail in FIGS. 3 and 4 of the drawings. As seen therein, connectors 46 are generally L-shaped elbows having a first leg 48 and an angularly related leg 50, located at a 90° angle to each other. Leg 50 has a flat face or end 52 formed thereon at its end, along with a longitudinal threaded bore 54 extending along its longitudinal axis. Flat face or end 52 has a diameter essentially identical to the diameter of the light fixture 22, and is positioned against plate 44 in the assembled condition of the device.

Figure 4:
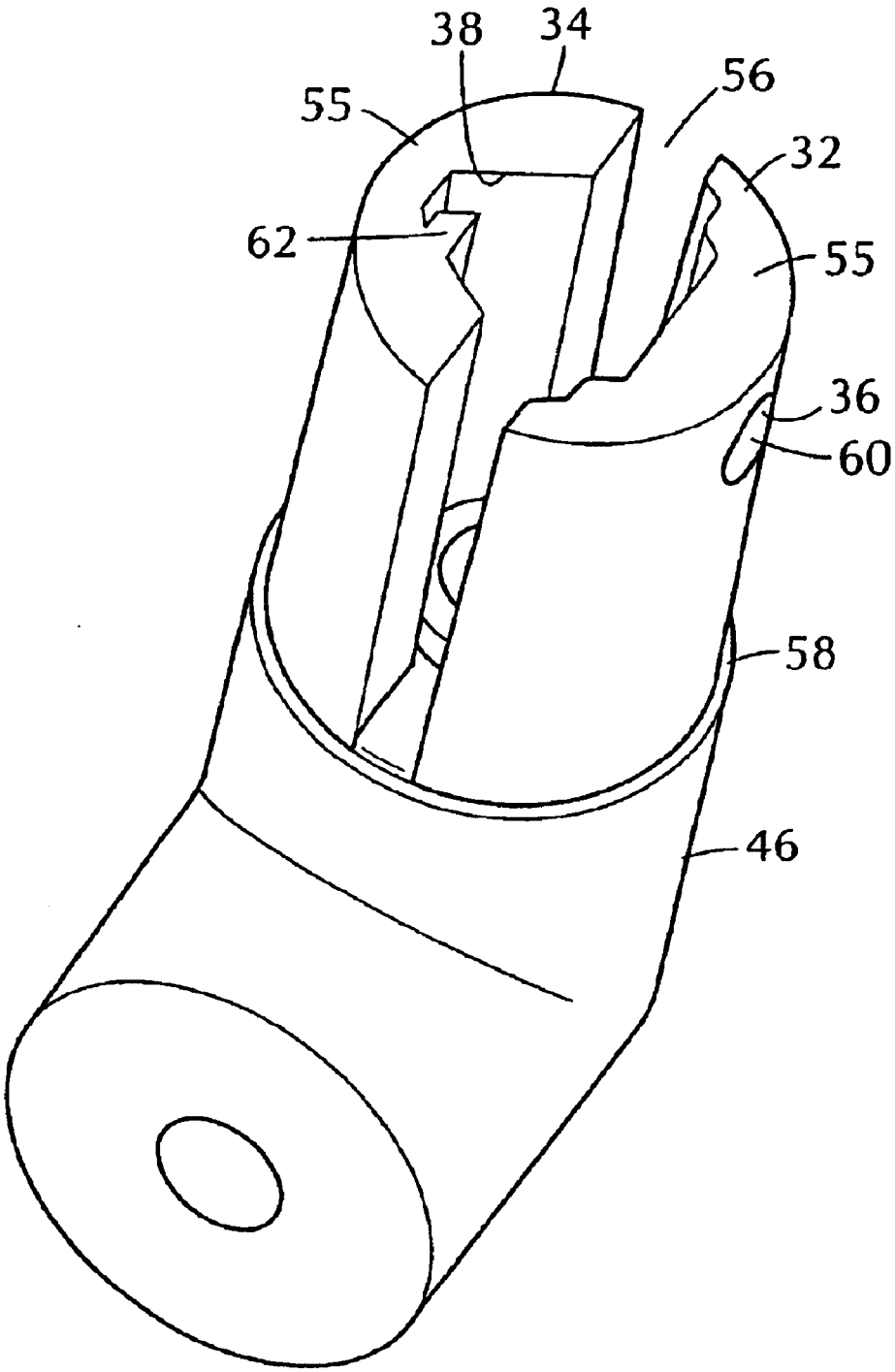
FIG. 4 is a perspective view from another angle of the elbow joint shown in FIG. 3.

The leg 48 of elbow 46 is formed of two semi-cylindrical clamp elements or legs 55, seen most clearly in FIG. 4, as an integral part of the elbow in a molded aluminum construct or the like. As also seen in FIG. 4, these elements are spaced from one another by a slot 56, and their effective diameter is slightly smaller than the diameter of the light fixture 22 and the internal diameter of support elements 12, 14, so that a peripheral lip 58 is formed on the elbow whose width is approximately the same as the cylindrical wall thickness of the support elements 12, 14. One of the legs 55 has a threaded opening 60 formed therein, while the other leg has an abutment 62 formed on its inner face in direct alignment with opening 60.

In order to secure the light fixture to support members 12, 14, legs 48 of the elbows 46 are inserted into the ends 18 of support members 12, 14. These support members have openings 64 formed on their inner sides, as seen in FIG. 5, through which a set screw 66 (only one of which is seen in FIG. 5) is threadedly engaged into the opening 60. By threading the screw to its full depth, the inner end 68 thereof engages the opposed abutment 62 in the leg 55, and causes the two legs 55 to be spread apart into tight friction engagement with the inner surface 70 of support members 12 or 14. As a result, the elbow is secured tightly to the support member.

Light fixture 22 is secured to the other legs 50 of elbows 46 by a hex nipple 72. A hex nipple is a known mechanical device which consists essentially of a hollow threaded shank 74 (see FIG. 5) and a hexagonal head 76 which has an opening therein communicating with the hollow bore in the shank.

With the lens of the light fixture removed, the light fixture is positioned between the ends 52 of the two elbows, and the hex nipple positioned through a central opening formed in the cover plate 44 into threaded engagement with the threaded bore 54 on the leg 50 of each of the elbows. Once the two hex nipples shown in FIG. 5 are threadedly engaged, the light fixture can be rotated through 360° into the desired position so that the opening on which the lens is placed can be directed upwardly, laterally, or downwardly. When the desired position is established, the hex nipples are tightened down and the rotatable light fixture is secured in place. Of course, if it is desired to change the angle at which light is directed, it is a simple matter to slightly loosen the hex nipples, rotate housing 24 to the new position and tighten them again.

As also seen in FIG. 5, threaded bore 54 communicates with an extension of the bore 78 formed in the leg 48 of the elbow. Thus, the two bores 54, 78 form a wireway or passage for the power supply wiring to the light fixture.

In the embodiment of the invention shown in FIG. 1, power is supplied through wires extending through the wall and support member 20, through the leg 14, the bores 78, 54, into the light fixture. There the power wires are connected in any convenient manner to the electrical support and contacts 36 for the fluorescent bulb 34.

In the embodiment of the invention illustrated in FIG. 5, a plug-in arrangement 80 for the power supply is provided. As seen therein, this power supply includes a ballast 82 with an outlet wire 84 extending through a hole 86 in leg 12, whereby the wire can pass through the support member 12 and the bores 78, 54 to supply current to the lamp.

Figure 2:
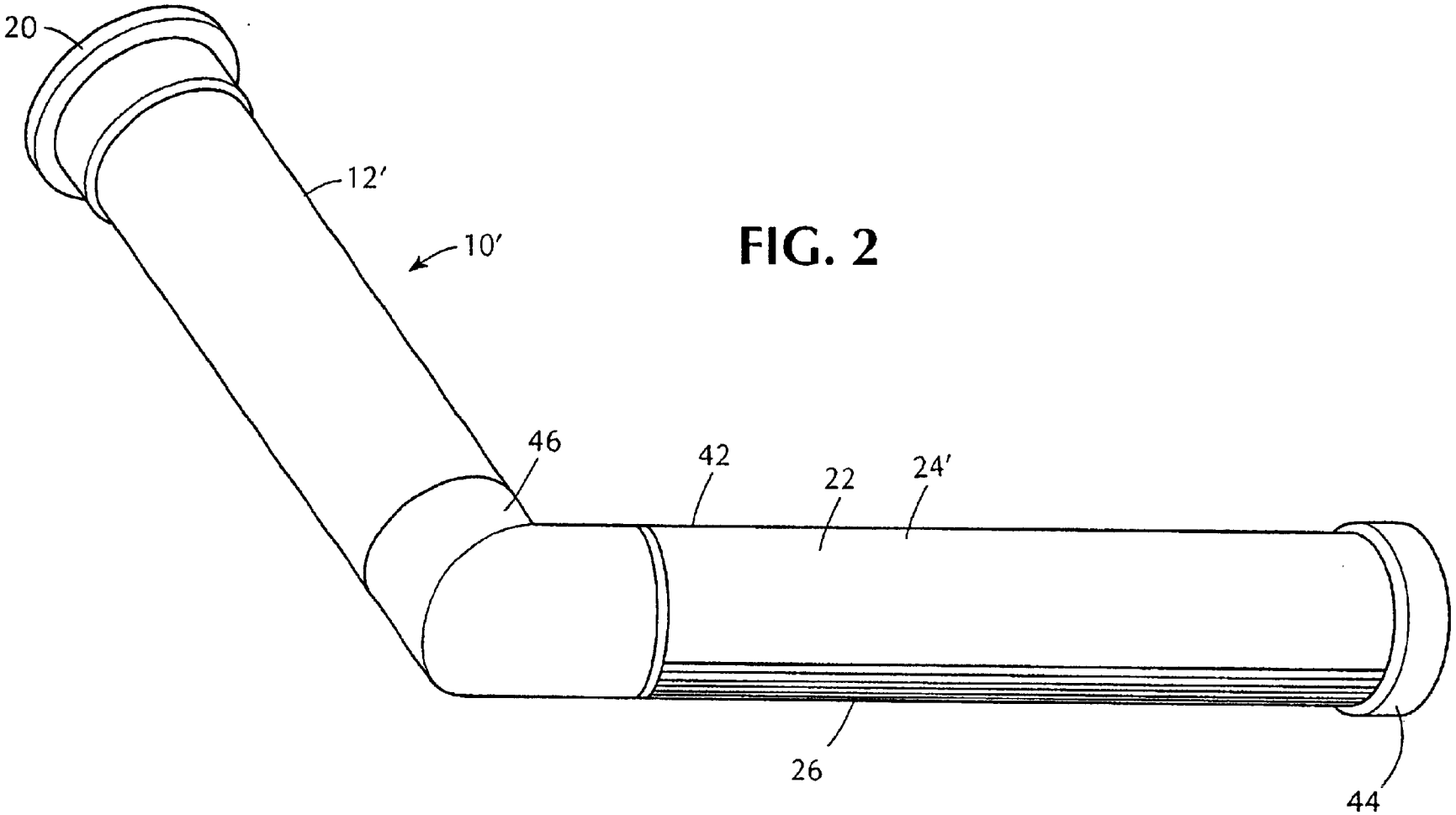
FIG. 2 is a perspective view from above of another embodiment of an illuminated garment holder, in this case having a single end support.

In the embodiment 10' of the invention illustrated in FIG. 2, a single lamp support leg 12' is provided mounted by the structure 20 to the wall or the ceiling of a room. Leg 12' is also connected to an elbow 46 as described above, of identical construction to that shown in FIGS. 4 and 5. Lamp fixture 22' is also of identical construction, and secured at one end 42 thereof, to elbow 46. The other end, as illustrated in the drawing, is unsupported, and simply closed by an end plate 44. Again, the light fixture 22' has a diameter sufficient to support a garment hanger in the garment display.

Figure 2A:
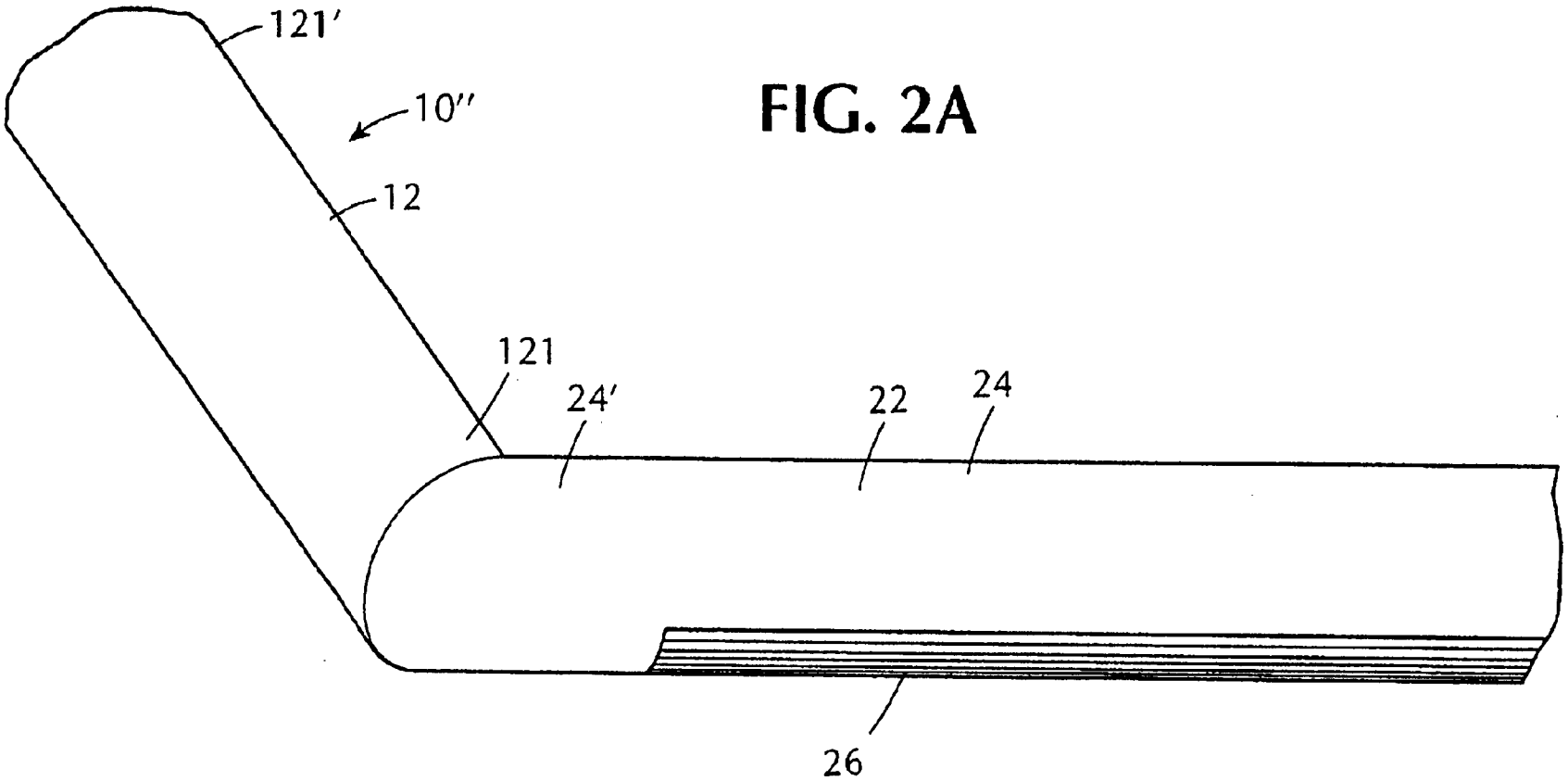
FIG. 2A is a partial view, similar to FIG. 2, of yet another embodiment of the invention.

In the embodiment 10" of FIG. 2A a single joint between a support 12 and light fixture 18 is shown which is suitable for use with either the embodiment of FIG. 1 or FIG. 2. In this case the end 121 of the support member 12 (opposite the end 121' that is supported on a wall or the like) is cut at a 45° angle. The adjacent end 24' of housing 24 is cylindrical and also cut at a 45° to mate with the 45° angle end of member 12. These two ends respectively receive the legs 50', 48' of an elbow 46'. These legs are identical to each other and to leg 48 described above with respect to the embodiment of FIG. 3, except that they are generally uniform in diameter to fit entirely in the ends 12' and 24' of support 12 and housing 24. They are secured to the ends 12', 24' by set screws as described above, which force legs 55 apart. As a result, the elbow is entirely concealed, as seen in FIG. 2A.

Figure 7:
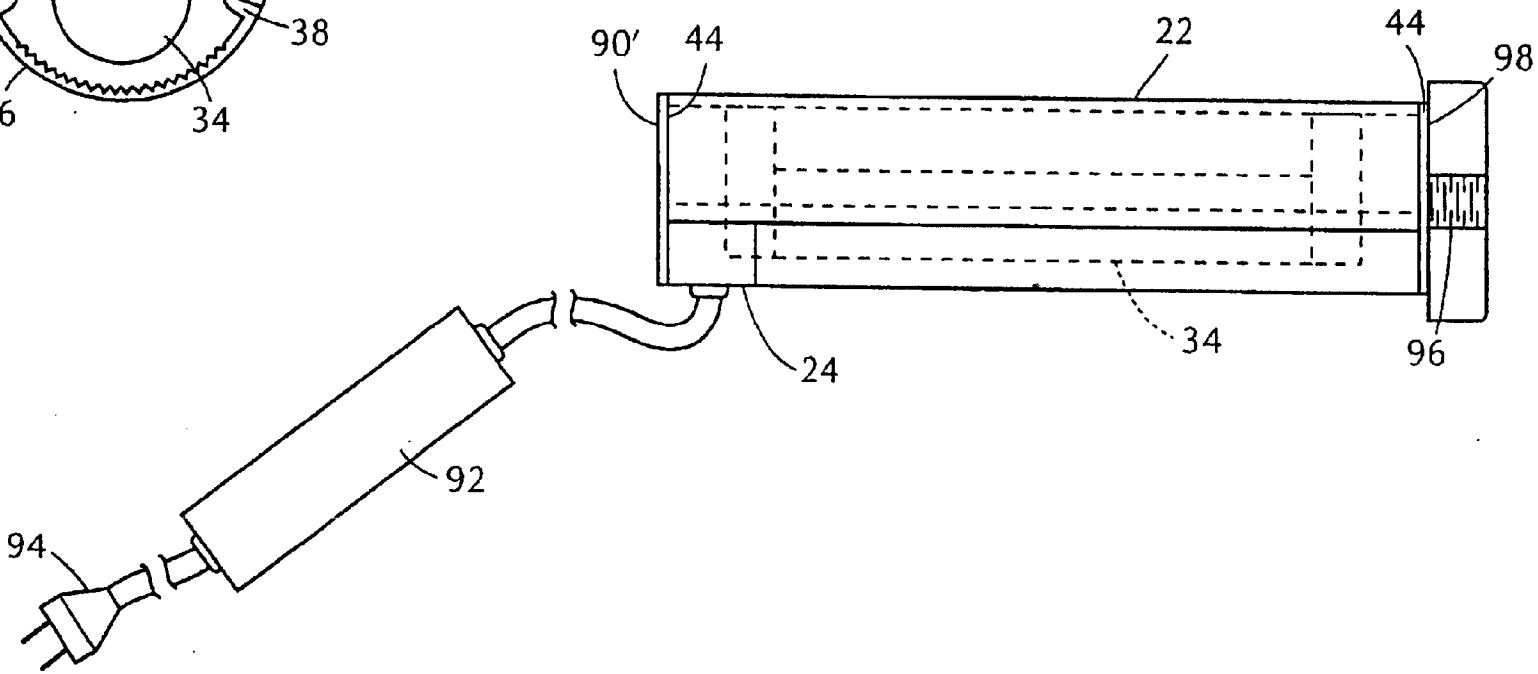
FIG. 7 is a plan view, similar to FIG. 6, of another embodiment of the invention.

In another embodiment of the invention illustrated in FIG. 7, lighting fixture 22 is identical to the fixture as previously described, except in this case one end 90 thereof, including the end plate 32, is secured directly to a wall to extend therefrom, for example, by bolts through the end plate 44 into the wall (not shown).

A ballast 92 is provided in an electrical supply line 94 which is connected through a portion of the housing 24 to provide current to the bulb 34 therein. The opposite end of the fixture 22, i.e. the right end as seen in FIG. 7, has a threaded extension 96 on its end plate 44. An end cap 98 of greater diameter than housing 24 is threadedly engaged on that extension, to form a stop for garment hangers supported on the fixture.

Although illustrative embodiments of the present invention have been described herein with reference to the accompanying drawings, it is to be understood that the invention is not limited to those precise embodiments, and that various changes and modifications may be effected therein by those skilled in the art, without departing from the scope and spirit of this invention.

What is claimed is:

1. A lighting device comprising at least one support member having a free end adapted to be secured to a wall or ceiling and an opposed end; a connecting joint mounted on the opposed end of said support member, a light fixture rotatably mounted on said connecting joint, and means for adjustably securing said light fixture in a selected position on the connecting joint against rotation, said securing means being juxtaposed to said light fixture; said light fixture being an elongated tube including a housing and a translucent lens mounted on the housing; and said at least one support member and said elongated tube being generally cylindrical and hollow and said connecting joint comprising a one piece elbow joint having two integral angularly related generally cylindrical legs, one of said legs being rotatably received within the opposed end of the hollow support member and the other of said legs being rotatably received within one end of the hollow elongated tube, whereby said tube is rotatable about its longitudinal axis on said other of said legs to said selected position.

2. A lighting device as defined in claim 1 wherein said lens extends along substantially the entire length of said tube.

3. A lighting device as defined in claim 1 wherein said tube is cylindrical and said lens extends along an arc of the tube which is less than 180°.

4. A lighting device as defined in claim 3 wherein said tube and lens include cooperating means for snap fitting the lens to the tube.

5. A lighting device as defined in claim 1 including means for securing the leg of the elbow joint in said opposed end of the support member against rotation.

6. A lighting device as defined in claim 5 wherein said lens extends along substantially the entire length of said tube.

7. A lighting device as defined in claim 5 wherein said tube is cylindrical and said lens extends along an arc of the tube which is less than 180°.

8. A lighting device as defined in claim 7 wherein said tube and lens include cooperating means for snap fitting the lens to the tube.

9. A lighting device comprising at least one support member having a free end adapted to be secured to a wall or ceiling and an opposed end; a connecting joint mounted on the opposed end of said support member, a light fixture rotatably mounted on said connecting joint, and means for adjustably securing said light fixture in a selected position on the connecting joint against rotation; said light fixture being an elongated tube including a housing and a translucent lens mounted on the housing; and said at least one support member and said elongated tube being generally cylindrical and said connecting joint comprising an elbow joint having two angularly related generally cylindrical legs, one of said legs being adapted to be rotatably received in the opposed end of the support member and the other of said legs being rotatably connected to one end of the elongated tube; and means for securing the leg of the elbow joint in said opposed end of the support member against rotation; said leg of the elbow joint which is received in said opposed end of the support member comprising a pair of spaced clamp elements and said means for securing that leg in the support member comprising means for urging said clamp elements away from each other into engagement with the inner surfaces of the support member.

10. A lighting device as defined in claim 9 wherein said means for urging said clamp elements away from each other includes a set screw threadedly engaged with one of said clamp elements and having a free end engaged against the other of said clamp elements for urging said clamp elements apart.

11. A lighting device as defined in claim 10 wherein said other of the legs of the elbow joint has a flat free end face and a bore extending longitudinally therethrough and communicating with a longitudinal bore in said one of the legs of the elbow joint, said light fixture having a first end portion positioned against the flat free end of said other leg of the elbow joint and said means for securing the light fixture on the connecting joint comprising a threaded bolt threadedly engaged in the bore in said other of the legs of the elbow joint.

12. A lighting device as defined in claim 11 wherein said threaded bolt is a hex nipple including a through bore formed therein, thereby defining a wireway from the support member through the elbow joint to the light fixture.

13. A lighting device as defined in claim 12 wherein said legs of the elbow joint are at 90° to each other.

14. A lighting device comprising a pair of generally cylindrical support tubes each having a free end adapted to be secured to a wall or ceiling; a pair of substantially identical connecting joints respectively mounted on the opposed ends of said support tube; an elongated light fixture having opposed ends respectively rotatably mounted on said connecting joints; and means for adjustably securing said light fixture in selected positions on the connecting joints against rotation, said securing means being juxtaposed to said light fixtures; said light fixture comprising an elongated tube including a housing and a translucent lens mounted on the housing, wherein said lens extends along substantially the entire length of said tube.

15. A lighting device as defined in claim 14 wherein said tube is cylindrical and said lens extends along an arc of the tube which is less than 180°.

16. A lighting device as defined in claim 15 wherein said tube and lens include cooperating means for snap fitting the lens to the tube.

17. A lighting device as defined in claim 14 wherein each of said connecting joints comprises an elbow joint having two angularly related generally cylindrical legs, one of said legs being rotatably received in its associated support member and the other of said legs being rotatably connected to its associated end of the light fixture.

18. A lighting device as defined in claim 17 including means for securing the leg of the elbow joint in its associated support member against rotation.

19. A lighting device as defined in claim 18 wherein the leg of each elbow joint received in the support tubes comprises a pair of spaced clamp elements and said means for securing that leg in its support member comprises means for urging said legs away from each other into engagement with the inner surfaces of the support member.

20. A lighting device as defined in claim 19 wherein the leg of each elbow joint received in the support tubes comprises a pair of spaced clamp elements and said means for securing that leg in its support member comprises means for urging said legs away from each other into engagement with the inner surfaces of the support member.

21. A lighting device as defined in claim 20 wherein the other of the legs of each of the elbow joints has a flat free end face and a bore extending longitudinally therethrough and communicating with a longitudinal bore is said one of the legs of the elbow joint, said opposed ends of the light fixture having flat free end faces positioned respectively against the flat free end faces of said elbow joints, and said means for securing the light fixture on the connecting joints comprise threaded bolts threadedly engaged in the other legs of the elbow joints having their heads inside the light fixtures to clamp the fixtures to the joint in any selected position.

22. A lighting device as defined in claim 21 wherein said threaded bolts are hex nipples including a through bore formed therein, thereby defining a wireway from the support member through the elbow joint to the light fixture.

23. A lighting device as defined in claim 22 wherein said legs of the elbow joint are at 90° to each other.

24. An illuminated hanger device comprising a generally cylindrical elongated tube having an elongated opening formed therein whose arc is less than 180°; a concave translucent lens mounted on said tube over said elongated opening; said tube having a first end portion adapted to be secured to a wall and a second free end portion; and an end cap secured to said second free end portion of said tube having a major dimension larger than the diameter of said tube thereby to serve as a stop for garment hangers supported on the tube; said tube and lens including cooperating means for snap fitting the lens to the tube; and end plates secured to the ends of said tube for closing said ends; the end plate on said second free end of the tube including a threaded extension and said end cap being threadedly engaged with said extension.

* * * * *